US012648607B2

(12) United States Patent
Musow et al.

(10) Patent No.: US 12,648,607 B2
(45) Date of Patent: Jun. 9, 2026

(54) PROCESS FOR A SAFETY HELMET WITH TELESCOPICALLY ADJUSTABLE HEAD SIZE

(71) Applicant: Dräger Safety AG & Co. KGaA, Lübeck (DE)

(72) Inventors: Jan Musow, Lübeck (DE); Mohamed Houssem Harbi, Lübeck (DE); Steffen Pracht, Lübeck (DE); Jasser Rahmatyan, Lübeck (DE)

(73) Assignee: DRÄGER SAFETY AG & CO. KGAA, Lübeck (DE)

( * ) Notice: Subject to any disclaimer, the term of this patent is extended or adjusted under 35 U.S.C. 154(b) by 418 days.

(21) Appl. No.: 18/314,889

(22) Filed: May 10, 2023

(65) Prior Publication Data

US 2023/0276890 A1 Sep. 7, 2023

Related U.S. Application Data

(62) Division of application No. 17/242,702, filed on Apr. 28, 2021, now Pat. No. 11,707,103.

(51) Int. Cl.
*A42B 3/14* (2006.01)

(52) U.S. Cl.
CPC ..... *A42B 3/145* (2013.01); *A42B 3/14* (2013.01)

(58) Field of Classification Search
CPC ..... A42B 3/145; A42B 3/14
See application file for complete search history.

(56) References Cited

U.S. PATENT DOCUMENTS

2015/0059066 A1* 3/2015 Ketterer ..... A42B 3/324 2/418

FOREIGN PATENT DOCUMENTS

WO WO-2021176061 A1 * 9/2021 ..... A42B 3/145

OTHER PUBLICATIONS

NPL: IP.com and IEEE, Results Publication Date Range: Mar. 7, 1983 to Dec. 3, 2025.*

* cited by examiner

*Primary Examiner* — Quang N Vo
(74) *Attorney, Agent, or Firm* — McGlew and Tuttle, P.C.

(57) ABSTRACT

A safety helmet with a helmet shell, with a bearing ring, with a rotatable actuating element (14) and with a transmission unit (15.1, 15.2). The transmission unit (15.1, 15.2) transmits a rotation of the actuating element to the bearing ring, so that the head size provided is changed. A helmet shell-side transmission piece (15.1) is non-rotatably connected to the actuating element (14) such that they rotate in unison, and a bearing ring-side transmission piece (15.2) is connected mechanically to the bearing ring. The helmet shell-side transmission piece (15.1) can move both relative to the actuating element (14) and relative to the bearing ring-side transmission piece (15.2) linearly in two opposite directions. The distance between the actuating element (14) and the bearing ring can be changed thereby.

6 Claims, 15 Drawing Sheets

PROCESS FOR A SAFETY HELMET WITH TELESCOPICALLY ADJUSTABLE HEAD SIZE

CROSS REFERENCE TO RELATED APPLICATIONS

This application is a divisional of, and claims the benefit of priority under 35 U.S.C. § 120 of, U.S. application Ser. No. 17/242,702 filed Apr. 28, 2021, which claims the benefit of priority under 35 U.S.C. § 119 of German Application 10 2020 002 610.9, filed Apr. 30, 2020, and German Application 10 2020 002 617.6, filed Apr. 30, 2020, the entire contents of each application are incorporated herein by reference.

TECHNICAL FIELD

The present invention pertains to a process for a safety helmet, wherein the helmet comprises an arched helmet shell, a bearing ring, a rotatable actuating element and a transmission unit. The bearing ring encircles the head of a user of the safety helmet and determines the head size, which the safety helmet provides. The length of the bearing ring and hence the head size provided can be changed by means of the actuating element. The transmission unit transmits a rotation of the actuating element to the bearing ring such that the head size provided will be changed.

BACKGROUND

Such a safety helmet (helmet 10) is known from U.S. Pat. No. 5,321,416. A bearing ring (headband 66 with front segment 70 and rear segment 68) encloses the head of the user. A transmission unit with a tube 94 and with a rotatable shaft 99 transmits a rotation of the actuating element (knob 90) to the bearing ring 66. Two socket head cap screws 96, 97 at the shaft 99 mesh with two slots 91, 92 in the tube 94.

Mechanisms for changing the head size of a safety helmet are also known from:

DE 10 2010 052 725 B3,
DE 198 82 440 B4,
DE 40 22 422 A1,
DE 1870098 U,
U.S. Pat. No. 5,373,588,
U.S. Pat. No. 7,174,575 B1,
US 2008/0295229 A1 and
US 2010/0050325 A1.

SUMMARY

A basic object of the present invention is to provide a safety helmet with a mechanism for changing the head size provided by the safety helmet, wherein the head size can be changed over a broader range than in prior-art safety helmets.

The object is accomplished by a safety helmet comprising:

an arched helmet shell,
a bearing ring,
an actuating element and
a transmission unit.

The arched helmet shell encloses a space. The designations "inside" and "outside" hereinafter used pertain to this space. The bearing ring is attached to the helmet shell on the inside and it encompasses the head of a user of the safety helmet fully or at least partially. The set length of the bearing ring sets (determines) the head size that the safety helmet provides.

The actuating element is rotatably attached to the helmet shell and is accessible from the outside.

The transmission unit transmits a rotation of the actuating element to the bearing ring. The safety helmet according to the present invention is configured such that the rotation of the actuating element increases or decreases the length of the bearing ring and hence the head size, which the bearing ring provides.

A distance is formed between the actuating element, which is arranged at the helmet shell on the outside, and the bearing ring, which is arranged at the helmet shell on the inside. As a rule, a rotation of the actuating element and hence a change in the length of the head size therefore cause a change in the distance between the actuating element, which is arranged at the helmet shell, and the bearing ring.

The transmission unit comprises:

a helmet shell-side transmission piece and
a bearing ring-side transmission piece.

The helmet shell-side transmission piece is non-rotatably (torque proof) connected to the actuating element such that they rotate in unison. The bearing ring-side transmission piece is non-rotatably connected (torque proof) to the helmet shell-side transmission piece such that they rotate in unison. It is, in addition, connected mechanically to the bearing ring. The bearing ring-side transmission piece may also be connected indirectly to the bearing ring, for example, by means of at least one toothed gear and a corresponding toothed element.

These two transmission pieces extend along a common longitudinal axis. The two transmission pieces together bridge at least a part of the distance between the actuating element and the bearing ring. Both transmission pieces preferably each have the shape of a rod.

The helmet shell-side transmission piece is linearly movable in two opposite directions relative to the actuating element, and these two opposite directions are both parallel to the common longitudinal axis of the two transmission pieces. The bearing ring-side transmission piece is linearly movable in parallel to this common longitudinal axis in the two opposite directions relative to the helmet shell-side transmission piece.

The distance between the actuating element and the bearing ring can be changed at least in the following ways:

By a linear movement of the helmet shell-side transmission piece relative to the actuating element in a direction parallel to the common longitudinal axis, and
by a linear movement of the bearing ring-side piece relative to the helmet shell-side transmission piece in a direction parallel to the common longitudinal axis.

The safety helmet comprises according to the present invention a bearing ring, wherein said bearing ring fully or at least partially surrounds the head of a user of the safety helmet. The bearing ring is preferably manufactured from a flexible material. Since the length of the bearing ring can be changed, the safety helmet can adapt itself to the head size and to the shape of the head of a user of the safety helmet, without a tool being needed for this purpose. Since the actuating element is accessible from the outside, the actuating element can be actuated while the safety helmet is seated on the head of a user. In order to adjust the head size provided, it is consequently unnecessary to remove the safety helmet.

If the head size provided is changed by means of the actuating element, the distance between the bearing ring and the helmet shell will often change as well. If the transmission unit were a single rigid component, for example, a rigid rod, the head size would either be able to be changed only within a very narrow range, or the transmission unit would have to be connected in an articulated manner to the actuating element and/or it would have to be connected in an articulated manner to the bearing ring. This would lead to a mechanically more complicated and more error-prone construction. In addition, hair of the user could be clamped. The transmission unit according to the present invention has, by contrast, a telescopic configuration, and it therefore avoids the drawbacks of a rigid transmission unit.

According to the present invention, the transmission unit comprises a helmet shell-side transmission piece and a bearing ring-side transmission piece. The bearing ring-side transmission piece is movable linearly (by a translatory movement) relative to the helmet shell-side transmission piece, this movement taking place in mutually opposite directions, which are parallel to the common longitudinal axis of the two transmission pieces. The length of the two-part transmission unit can be changed continuously within a relatively broad range. As a result, the distance between the bearing ring and the actuating element can be changed continuously within a relatively broad range as well.

The helmet shell-side transmission piece is, in addition, movable linearly relative to the actuating element in these two opposite directions. On the whole, two relative movements are possible, namely, between the bearing ring-side transmission piece and the helmet shell-side transmission piece, on the one hand, and between the helmet shell-side transmission piece and the actuating element, on the other hand. The head size provided by the safety helmet can be changed continuously within a relatively broad range especially based on these two possible relative movements. As a result, a plurality of identical safety helmets according to the present invention can be used for users having relatively greatly different head sizes and/or head shapes. It is unnecessary in many cases to provide different variants of the safety helmet for different head sizes. In addition, a user may optionally use the same safety helmet with and without an additional head cover on the head and under the safety helmet.

Since, on the whole, three components of the safety helmet are displaceable linearly relative to one another and two different relative movements are therefore possible, redundancy is made possible. The distance between the actuating element and the bearing ring can still be changed in a relatively broad range even then, if, for example, one of the two relative movements is not possible any longer because of a technical defect. The other relative movement can then frequently still be carried out. The remaining relative movement that is still possible makes it possible for the distance between the actuating element and the bearing ring to be able to be changed despite the defect.

The safety helmet preferably comprises an intermediate piece. The intermediate piece is non-rotatably (torque-proof) connected to the actuating element in such a way that they rotate in unison and is non-rotatably (torque-proof) connected to the helmet shell-side transmission piece such that they rotate in unison. As a result, a rotation of the actuating element is transmitted to the intermediate piece, on the one hand. On the other hand, a rotation of the intermediate piece is transmitted to the helmet shell-side transmission piece. The two transmission pieces and the intermediate piece preferably bridge together the distance between the actuating element and the bearing ring completely. Thanks to the intermediate piece, a greater distance can be bridged between the actuating element and the bearing ring.

In one embodiment, the actuating element is connected permanently to the intermediate piece and it is therefore not movable relative to the intermediate piece, and it is especially not displaceable linearly. In a preferred embodiment, the actuating element is, by contrast, linearly displaceable relative to the intermediate piece. As a result, the distance between the actuating element and the bearing ring can be changed in an ever broader range. On the whole, four components of the safety helmet are displaceable linearly relative to one another, namely, the actuating element, the intermediate piece and the two transmission pieces. Thanks to the configuration with the movable intermediate piece between the actuating element and the transmission unit, the distance between the actuating element and the bearing ring can vary in an even broader range.

The intermediate piece is non-rotatably connected to the helmet shell-side transmission piece such that they rotate in unison. The helmet shell-side transmission piece is movable in the two opposite directions relative to the actuating element, this being possible due to the fact that the helmet shell-side transmission piece is movable relative to the intermediate piece in the two opposite directions.

The actuating element preferably encloses the intermediate piece from all sides. A user can therefore rotate the actuating element in order to adjust the head size, and he does not need to actuate the intermediate piece directly. In one embodiment, the intermediate piece is passed completely through the hollow actuating element.

At least one pair of two corresponding stop elements limits a linear movement of the helmet shell-side transmission piece relative to the intermediate piece. The one stop element belongs to the helmet shell-side transmission piece, and the other stop element belongs to the intermediate piece. These two stop elements especially preferably limit a movement of the helmet shell-side transmission piece away from the actuating element.

The intermediate piece is preferably hollow, and the helmet shell-side transmission piece meshes with (engages into) the intermediate piece. The depth to which the helmet shell-side transmission piece engages into the intermediate piece depends here especially preferably on the rotary position of the actuating element relative to the helmet shell.

In an alternative, the helmet shell-side transmission piece is hollow, and the intermediate piece engages into the helmet shell-side transmission piece. The depth to which the intermediate piece engages into the helmet shell-side transmission piece preferably depends on the rotary position of actuating element relative to the helmet shell according to this alternative as well.

According to the embodiment just described, the intermediate piece is non-rotatably connected to the helmet shell-side transmission piece such that they rotate in unison. In a preferred variant, this connection rotating in unison is embodied as follows. The helmet shell-side transmission piece has an outer profile. The intermediate piece has an inner profile. As an alternative, the helmet shell-side transmission has an inner profile, and the intermediate piece has an outer profile. The outer profile corresponds to the inner profile in both embodiments. At least one projection of the outer profile meshes (engages) with a corresponding recess of the inner profile, or a projection of the inner profile engages with a corresponding recess of the outer profile. The projection may be an elongated bead, and the recess may be a groove. The bead and the groove extend along the common longitudinal axis.

The embodiment with two corresponding profiles embodies the connection rotating in unison in an especially reliable manner and makes it possible for the helmet shell-side transmission piece to be movable linearly relative to the intermediate piece. The torque is distributed over the entire overlapping area between the helmet shell-side transmission piece and the intermediate piece along the common longitudinal axis. The length of this overlapping area depends, as a rule, on the rotary position of the actuating element relative to the helmet shell.

According to the present invention, the actuating element is connected rotatably to the helmet shell. In one embodiment, this rotatable connection is brought about by means of the intermediate piece. The intermediate piece is connected rotatably to the helmet shell and is attached to the helmet shell. The actuating element is non-rotatably connected to the intermediate piece permanently and especially such that they rotate in unison. A distance, which is bridged by the intermediate piece, is preferably formed between the actuating element and the helmet shell. This embodiment makes it possible in many cases to configure the actuating element such that it can be grasped and rotated easily, even if a user of the safety helmet is using gloves. In particular, the actuating element may project sufficiently far over the arched helmet shell.

In a preferred embodiment, the intermediate piece is passed through the entire actuating element. This embodiment has an especially good mechanical stability in many cases.

In one embodiment, the safety helmet comprises a disk, which is visible from the outside. This disk encloses the intermediate piece. The actuating element encloses the disk. The disk reduces the risk of liquid or particles entering into the interior of the helmet shell. The disk may identify, for example, the safety helmet or a user of the safety helmet, for example, by a certain color.

According to the present invention, the bearing ring-side transmission piece is movable linearly in both opposite directions relative to the helmet shell-side transmission piece. In a preferred embodiment, a pair of two corresponding stop elements limits this relative movement in one direction. One stop element belongs to the helmet shell-side transmission piece, and the other stop element belongs to the bearing ring-side transmission piece. The two corresponding stop elements especially preferably limit a movement of the bearing ring-side transmission piece away from the actuating element. This embodiment additionally reduces the risk of damage to the transmission piece during the rotation of the actuating element.

In a preferred embodiment, the helmet shell-side transmission piece is hollow. The bearing ring-side transmission piece engages with the helmet shell-side transmission piece. The transmission unit consequently tapers at least once from the actuating element to the bearing ring. This configuration takes into account especially well the fact that less space is frequently available close to the bearing ring than close to the actuating element. How deeply the bearing ring-side transmission piece engages on the inside with the helmet shell-side transmission piece depends especially preferably on the rotary position of the actuating element relative to the helmet shell. It is also possible that the bearing ring-side transmission piece is hollow and the helmet shell-side transmission piece engages on the inside with the bearing ring-side transmission piece.

The bearing ring-side transmission piece is non-rotatably connected according to the present invention to the helmet shell-side transmission piece such that they rotate in unison. In a preferred embodiment, in which the helmet shell-side transmission piece is hollow, an outer profile of the bearing ring-side transmission piece corresponds to an inner profile of the helmet shell-side transmission piece. In an alternative embodiment, in which the bearing ring-side transmission piece is hollow, an outer profile of the helmet shell-side transmission piece corresponds to an inner profile of the bearing ring-side transmission piece. In turn, at least one projection of the outer profile engages with a corresponding recess of the inner profile or vice versa. This embodiment with two corresponding profiles also leads to the advantages that were described above with reference to the helmet shell-side transmission piece and the intermediate piece.

According to the present invention, the actuating element is rotatable relative to the helmet shell. The actuating element and the two transmission pieces are preferably rotatable about the common longitudinal axis of the two transmission pieces relative to the helmet shell. It is also possible, however, that a lateral offset develops between the axis of rotation of the actuating element and the common axis of rotation of the two transmission pieces.

The bearing ring-side transmission piece is connected according to the present invention mechanically to the bearing ring. In a preferred embodiment, the transmission unit additionally comprises at least one transmission element, which is mounted rotatably. The rotatable transmission element or a rotatable transmission is preferably configured as a toothed gear, which engages with a toothed element on the bearing ring. In a preferred embodiment, the bearing ring-side transmission piece is non-rotatably connected to the rotatably mounted transmission or to a rotatably mounted transmission element such that they rotate in unison. A rotation of the actuating element is transmitted therefore to the rotatably mounted transmission element by means of the transmission unit, and this rotation causes the head size provided by the bearing ring to be changed.

According to the present invention, the transmission unit transmits a rotation of the actuating element to the bearing ring. This transmitted rotation causes the head size provided by the bearing ring to be changed. In one embodiment, the bearing ring comprises two bearing ring parts, which are movable relative to one another. The bearing ring-side transmission piece is connected mechanically to at least one bearing ring part, and preferably to both bearing ring parts, for example, via the above-described rotatable transmission element, which especially preferably has the form of a toothed gear. A movement of one bearing ring part relative to the other bearing ring part leads to a change in the head size, which is provided by the bearing ring.

In one embodiment, at least the bearing ring, the actuating element and the two-part transmission unit of a safety helmet according to the present invention are produced by at least one 3D printer, and so is preferably additionally the optional intermediate piece as well. Different components of the safety helmet are optionally produced by different 3D printers, also at different locations. The helmet shell is likewise produced in one embodiment by a 3D printer, and by another manufacturing process in another embodiment. The components are preferably assembled into a safety helmet according to the present invention.

The present invention pertains to a safety helmet and, in addition, to a process providing a 3D printer, on the one hand, which is configured to produce (print) the components of a safety helmet according to the present invention, which were just mentioned. An arrangement with a plurality of 3D printers, which produce each at least one component of the safety helmet according to the present invention, is possible.

On the other hand, the present invention pertains to a computer program, which can be executed on a computer. If the computer program is executed on the computer, the computer controls at least one 3D printer. The actuated 3D printer produces the components just listed of the safety helmet according to the present invention. The computer optionally actuates a plurality of 3D printers for different components. It is also possible that different computer programs actuate each a computer, and each actuated computer produces at least one component of the safety helmet according to the present invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
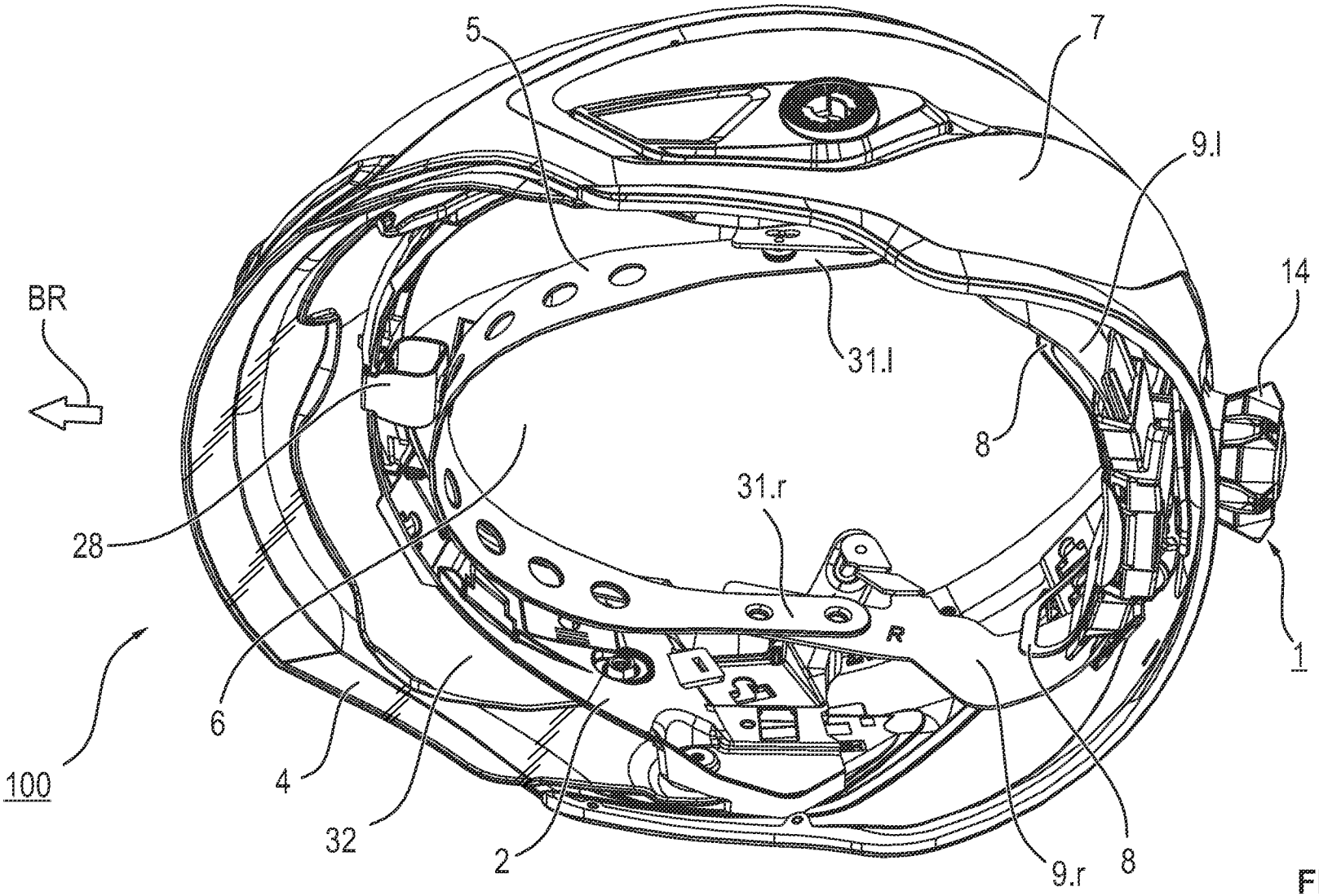
FIG. 1 is a perspective view showing a safety helmet obliquely from below.

Referring to the drawings, the present invention pertains to a safety helmet, which can be used by firefighters, police, rescue workers and members of other rescue teams in order to better protect the head from mechanical, thermal and chemical effects.

The safety helmet according to the exemplary embodiment comprises—just like many other safety helmets—a helmet shell made of a hard material, a bearing (support) structure and an inner lining. The inner lining is in contact with the head of a person, who is wearing this safety helmet on his head, and it comprises textile components. This person will hereinafter be called "the user."

The designations "left", "right", "front", "rear", top", and "bottom" which will be used below pertain to the usual orientations when the safety helmet is seated on the head of a user and the user is looking forward. The viewing direction BR of a user looking straight forward is shown in some figures. The inner lining is omitted in the figures.

The bearing structure connects the inner lining to the helmet shell and comprises a sequence of a plurality of parts of a bearing ring, wherein the bearing ring is led completely around the head of the user. The bearing ring is manufactured from a flexible material and can adapt itself up to a certain degree to the shape of the head and to the size of the head of a user. This circular bearing ring shall be in contact with the head without a major clearance, on the one hand, in order for the safety helmet not to slip during use. Therefore, there is, as a rule, a distance between the bearing ring and the helmet shell. On the other hand, the bearing ring shall not press the head. The bearing ring must therefore be able to be adapted to the head size of the user. The flexibility of the material alone is not sufficient for this adaptation. The "head size" of the bearing ring, which is the actual length of the bearing ring being in contact with the head of the user, will also be referred to hereinafter.

The safety helmet according to the exemplary embodiment therefore comprises—just as many prior-art safety helmets—an actuating unit with a handwheel, with which the head size can be changed manually. A rotation of the handwheel leads to a change in the overall length of the bearing ring. This rotation must be transmitted to the bearing ring in the interior of the helmet shell. How this happens in the exemplary embodiment will be described below. The handwheel acts as the actuating element according to the patent claims.

A problem solved by the present invention is that the handwheel must remain in mechanical contact with the bearing ring in order for the user to be able to adjust the head size by a rotation of the handwheel. On the other hand, the distance between the handwheel and the bearing ring shall, however, be able to vary within a broad range in order to be able to change the head size in a broad range.

Figure 2:
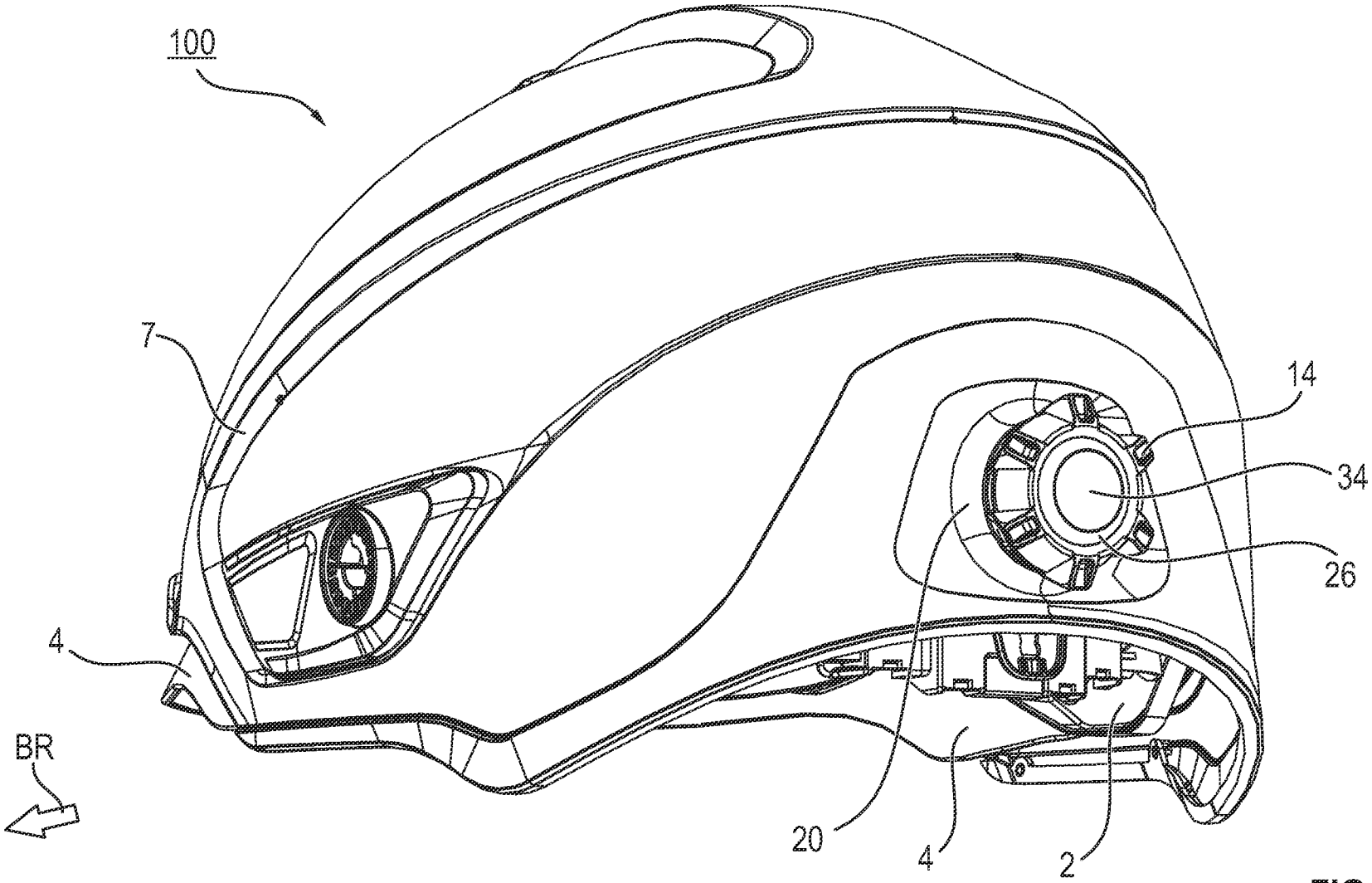
FIG. 2 is a perspective view showing the safety helmet, from FIG. 1, obliquely from a rear side.
Figure 3:
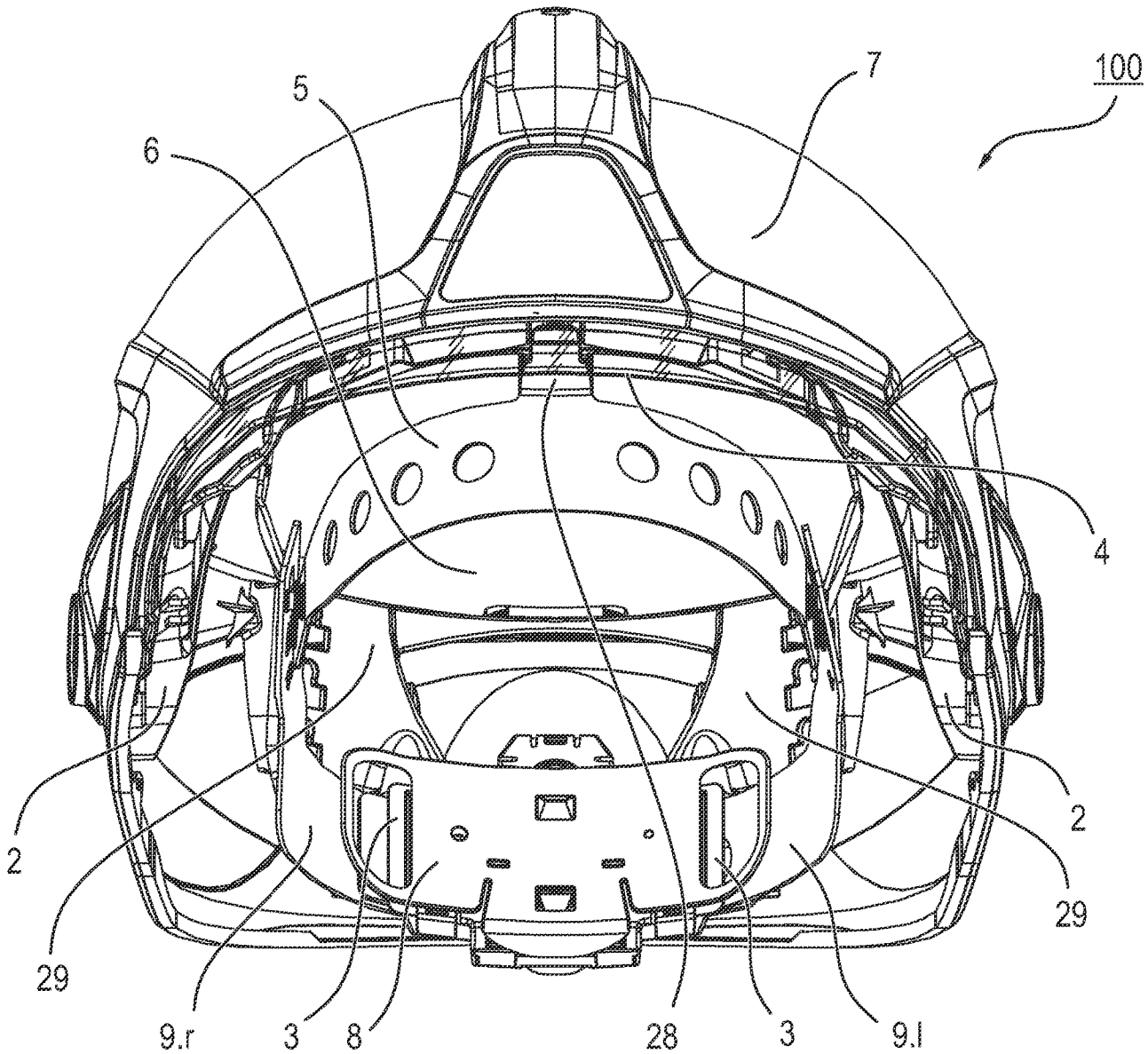
FIG. 3 is a front view showing the safety helmet, from FIG. 1, horizontally.

FIG. 1 through FIG. 3 show a safety helmet 100 in three perspective views. This safety helmet 100 comprises:

- an arched helmet shell 7, which is preferably manufactured from a hard material, i.e., it cannot adapt itself to the shape of the head of a user,
- a shock-absorbing shell 6, which is in contact on the inside with the helmet shell 7 and is manufactured from a plastically deformable material, so that the shock-absorbing shell 6 can absorb kinetic energy,
- a front holding ring part 2, which is in contact on the inside with the shock-absorbing shell 6 and is connected to the helmet shell 7,
- a rear holding ring part 29, which is likewise in contact with the shock-absorbing shell 6 and is connected to the helmet shell 7,
- a pivotable visor 4, which is connected rotatably to the helmet shell 7, wherein the visor 4 is located in front of the eyes of the user when it is pivoted down,
- a horseshoe-shaped front bearing ring part 5, which is in contact with the forehead of a user,
- a left rear bearing ring part 9.*l* and a right rear bearing ring part 9.*r*, which have a distance from the head of the user, an intermediate piece 28, which connects the front bearing ring part 5 to the front holding ring part 2, a central rear bearing ring part in the form of a bearing support 8 for the back of the head, wherein the bearing support 8 for the back of the head is in contact with the back of the head of the user and is permanently connected to the helmet shell 7, a guide element 3, which is connected to the bearing support 8 of the back of the head and which will be described below, a transmission unit 10, 11, 12, 15, which will likewise be described below, and an actuating unit 1 for adjusting the head size of the safety helmet 100, wherein the actuating unit 1 comprises a handwheel 14, which is accessible from the outside and which is attached rotatably in the rear at the helmet shell 7 and projects outwards over the helmet shell 7.

The front bearing ring part 5 is connected by a respective snap-in connection 31.*l*, 31.*r* each to the two rear bearing ring parts 9.*l* and 9.*r*. The central rear bearing ring part (bearing support for the back of the head) is located between the two rear bearing ring parts 9.*l* and 9.*r* and is connected to these. The front bearing ring part 5, the rear bearing ring parts 9.*l*, 9.*r* and the bearing support 8 for the back of the head together form the bearing ring according to the exemplary embodiment, which fully encompasses the head of the user and is partially in contact with the head. This bearing ring 5, 8, 9.*l*, 9.*r* defines (determines/sets) the head size of the safety helmet 100. The index .l designates a left component and the index .r designates a right component.

The front bearing ring part 5 is preferably enclosed by a textile sheathing. This textile sheathing is located between the front bearing ring part 5 and the forehead of a user of the safety helmet 100. The textile sheathing cushions the front bearing ring part 5 and absorbs sweat. The textile sheathing can especially preferably be removed from the front bearing ring part 5 and cleaned separately from the rest of the safety helmet 100, or the bearing ring part 5 can be removed and cleaned together with the textile sheathing. The bearing support 8 for the back of the head preferably also has a textile sheathing or at least a cushioning.

The front holding ring part 2 and the rear holding ring part 29 form together a circular holding ring, which is permanently connected to the helmet shell 7. If the head size provided by the bearing ring 5, 8, 9.*l*, 9.*r* is changed, the length of the holding ring 2, 29 preferably remains constant. The distance between the bearing ring 5, 8, 9.*l*, 9.*r* and the holding ring 2, 29 therefore changes in case of a change in the head size.

In order to increase the head size, the left rear bearing ring part 9.*l* can be displaced horizontally and linearly to the left relative to the central rear bearing ring part 8, and the right rear bearing ring part 9.*r* can be displaced horizontally and linearly to the right relative to the central rear bearing ring part 8. The two snap-in connections 31.*l*, 31.*r* between the front bearing ring part 5 and the two rear bearing ring parts 9.*l* and 9.*r* move along during this displacement. To reduce the head size, the two rear bearing ring parts 9.*l*, 9.*r* can be displaced correspondingly to the right and to the left. The guide element 3 guides the two movable rear bearing ring parts 9.*l*, 9.*r* during these linear displacements.

The handwheel 14 of the actuating unit 1 comprises a round grip element 45 with a plurality of projections 44. A user can better grasp the handwheel 14, even if he is using gloves, by means of the projections 44. The handwheel 14 is mechanically connected to the two rear bearing ring parts 9.*l*, 9.*r*, which will be described farther below. It is possible that a closing unit, not shown, e.g., a cap, can be attached to the handwheel 14 and removed again.

Figure 4:
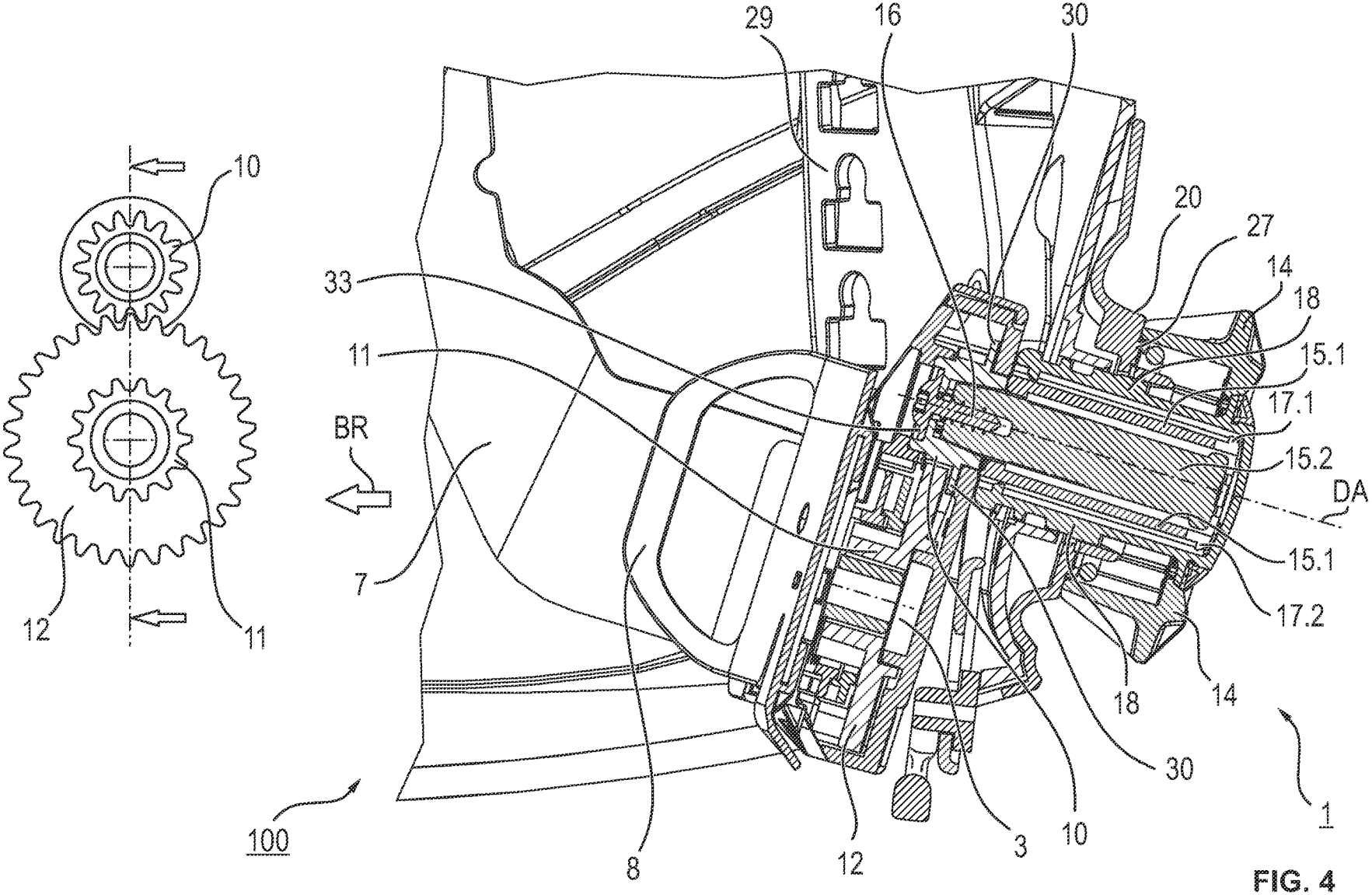
FIG. 4 is a cross-sectional view and plan view showing the actuating unit and the transmission unit.

FIG. 4 shows on the right-hand side a part of the helmet shell 7, the actuating unit 1 and the transmission unit 10, 11, 12, 15 in a cross-sectional view. The cross-sectional area is arranged at right angles and is located in the middle of the safety helmet 100. The common rotation axis DA of the actuating unit 1 and of the transmission unit 10, 11, 12, 15 is located in the drawing plane in the right-hand part of FIG. 4 and is at right angles to the view in the left-hand part of FIG. 4.

Figure 5:
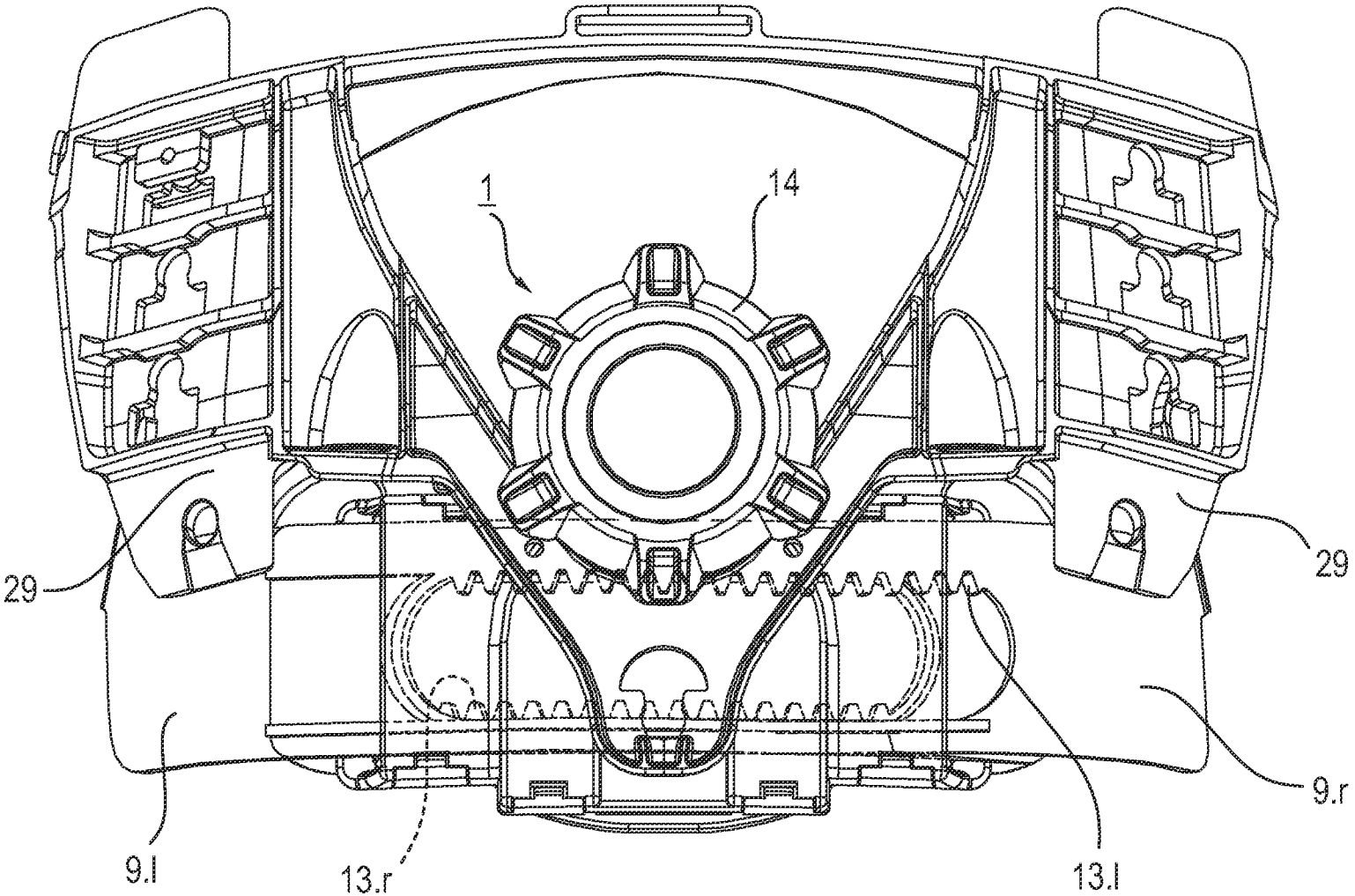
FIG. 5 is a rear view showing the actuating unit and the rear bearing ring.
Figure 6:
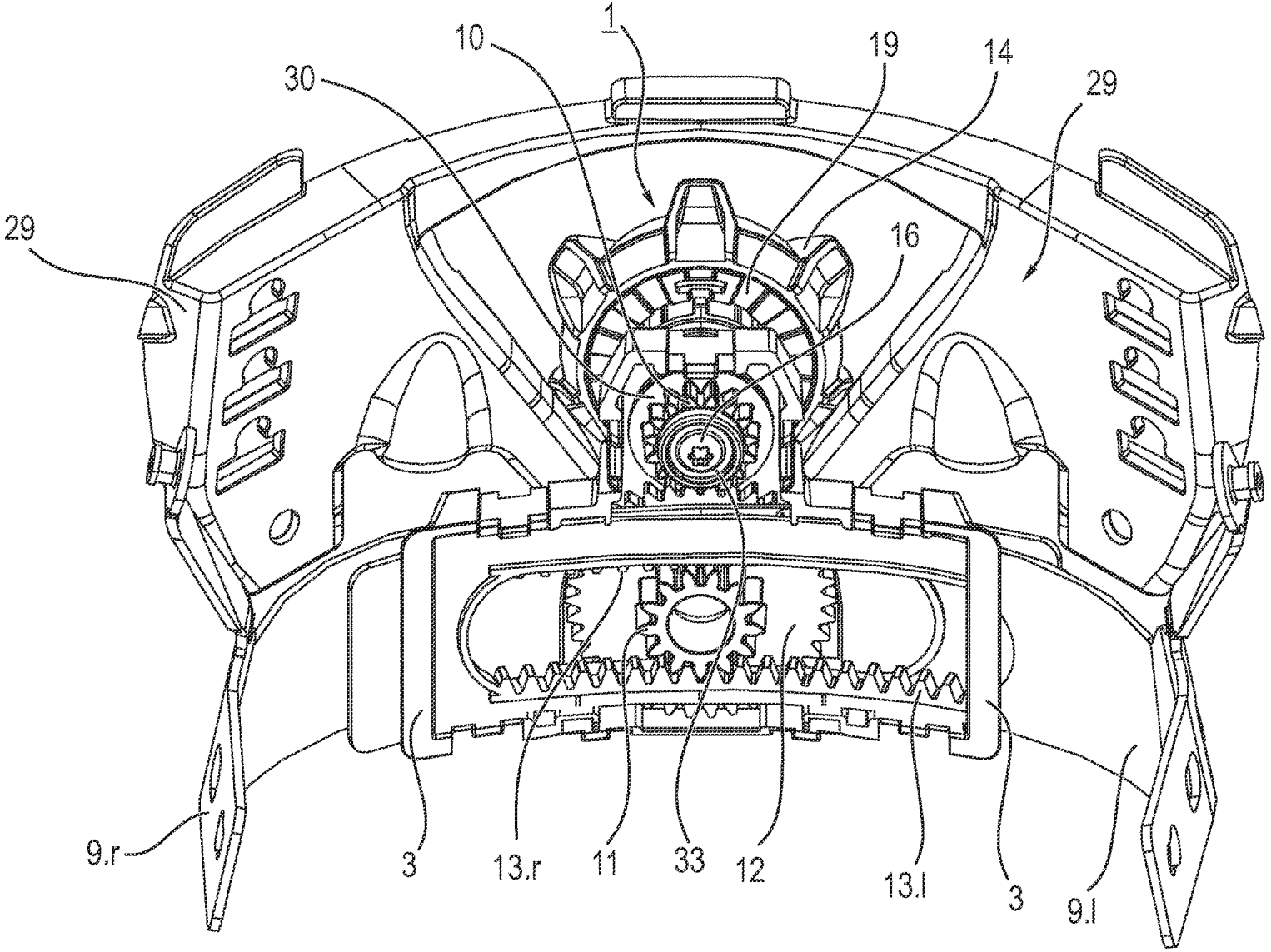
FIG. 6 is a front view showing the actuating unit and the rear bearing ring.

FIG. 5 and FIG. 6 show the actuating unit 1, the rear holding ring part 29 and the rear bearing ring parts 9.*l* and 9.*r*. FIG. 5 shows the viewing direction BR away from the viewer, and FIG. 6 shows the oblique viewing direction towards the viewer. The front bearing ring part 5 and the bearing support 8 for the back of the head are omitted in FIG. 6.

Figure 7:
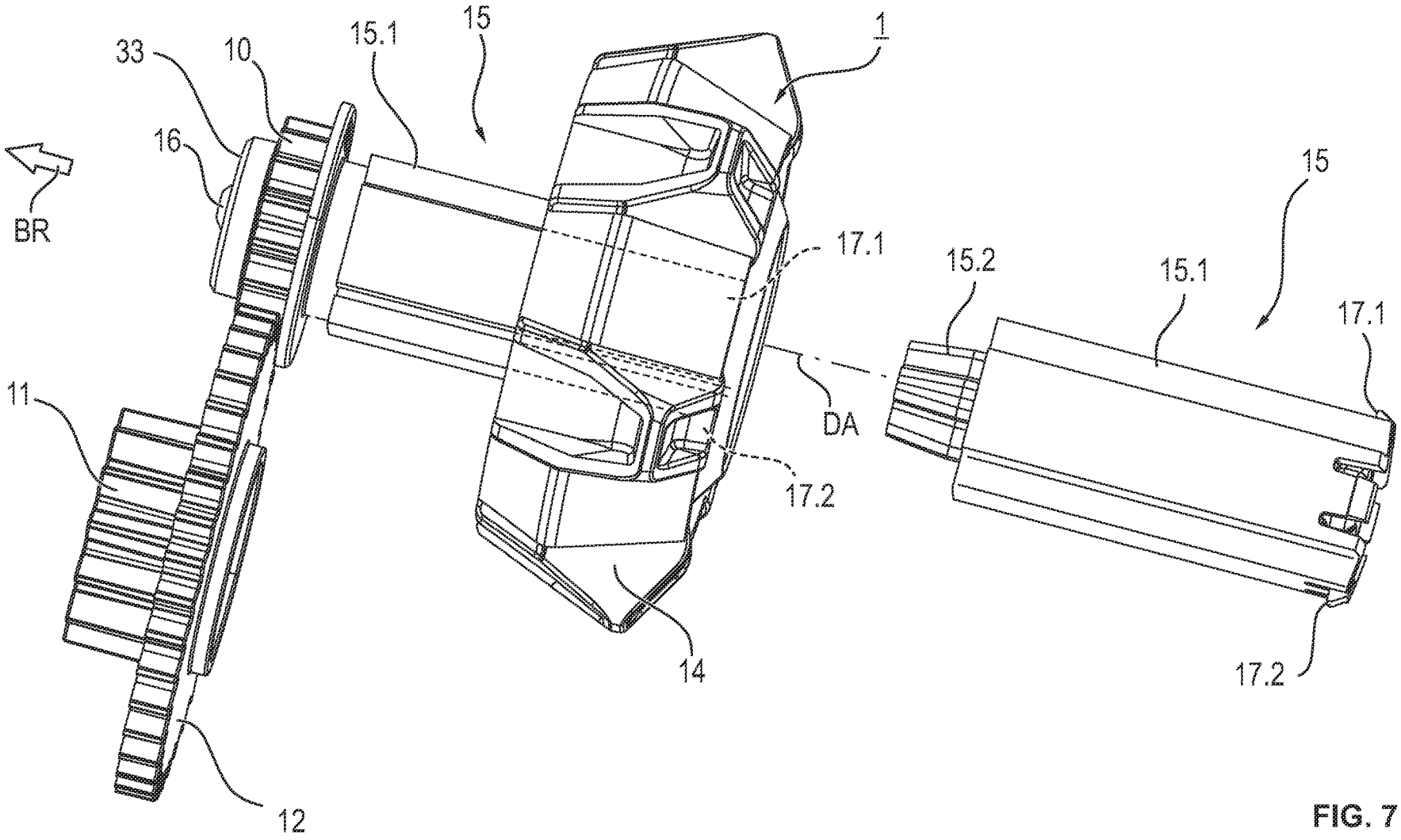
FIG. 7 is a perspective view showing the actuating unit and the toothed gears of the transmission unit, which transmits a rotation of the actuating unit to the two rear bearing rings, from the side.

FIG. 6 and FIG. 7 illustrate how a rotation of the actuating unit 1 leads to a synchronous displacement of the two rear bearing ring parts 9.*l* and 9.*r* towards one another or away from one another. A driving toothed gear 10 is non-rotatably connected to the actuating unit 1 such that they rotate in unison. The distance between the toothed gear 10 and the actuating unit 1 is variable. A rotation of the actuating unit 1 brings about a rotation of the driving toothed gear 10 to the left or to the right. The driving toothed gear 10 meshingly engages a larger driven toothed gear 12. The larger driven toothed gear 12 is permanently connected to a smaller driven toothed gear 11, cf. left-hand part of FIG. 4. The smaller driven toothed gear 11 meshingly engages both a toothed segment 13.*l* of the left rear bearing ring part 9.*l* and a toothed segment 13.*r* of the right rear bearing ring part 9.*r*. Consequently, toothed gears 10, 11 and 12 provide together a transmission gear. The guide element 3 prevents a toothed segment 13.*l*, 13.*r* from yielding.

FIG. 7 shows the transmission gear 10, 11, 12 as well as the actuating unit 1 in a perspective view from the side. The common rotation axis DA is located in the drawing plane of FIG. 7. The following components also belong to the mechanism with which the head size of the bearing ring 5, 8, 9.*l*, 9.*r* can be changed:

a telescopic bar 15, which comprises a tube 15.1 and a pin 15.2, a disk 33 at the front end of the pin 15.2, wherein the disk 33 has a through hole for the pin 15.2 and is permanently connected to the driving toothed gear 10, and a screw 16, which is screwed centrally into a corresponding screw hole 25 in the pin 15.2, is permanently connected to the disk 33 and which holds the toothed gear 10 and the disk 33 at the tube 15.1.

The actuating unit 1 with the handwheel 14 and the telescopic bar 15 are rotatable relative to the helmet shell 7 about the common rotation axis DA in the exemplary embodiment. The tube 15.1 acts in the exemplary embodiment as the helmet shell-side transmission piece and the pin 15.2 as the bearing ring-side transmission piece. Both transmission pieces 15.1 and 15.2 extend along the common rotation axis DA.

The transmission unit 10, 11, 12, 15 is supported at the rear holding ring part 29, cf. also FIG. 4. The screw 16 with the disk engages on the inside with the pin 15.2. The pin 15.2 is pushed partially into the tube 15.1. The tube 15.1 engages with the handwheel 14 or projects over the handwheel 14. The transmission piece 15 is shown twice in FIG. 7, namely, once together with the actuating unit 1 and with the toothed gears 10, 11, 12 (left) and once separately (right). The rotation axis DA is identical in both views.

The actuating unit 1 comprises in the exemplary embodiment:

- The handwheel 14 comprising the grip element 45 with the projections 44,
- an intermediate piece in the form of a handwheel tube 18, which handwheel tube engages on the inside with the handwheel 14 and is even passed through the handwheel 14 in one embodiment,
- a fluted disk 19,
- an outwardly arched disk 34, which closes the handwheel tube 18,
- an identification plate 26,
- a sealing ring 47 and
- a circlip 48.

Figure 8:
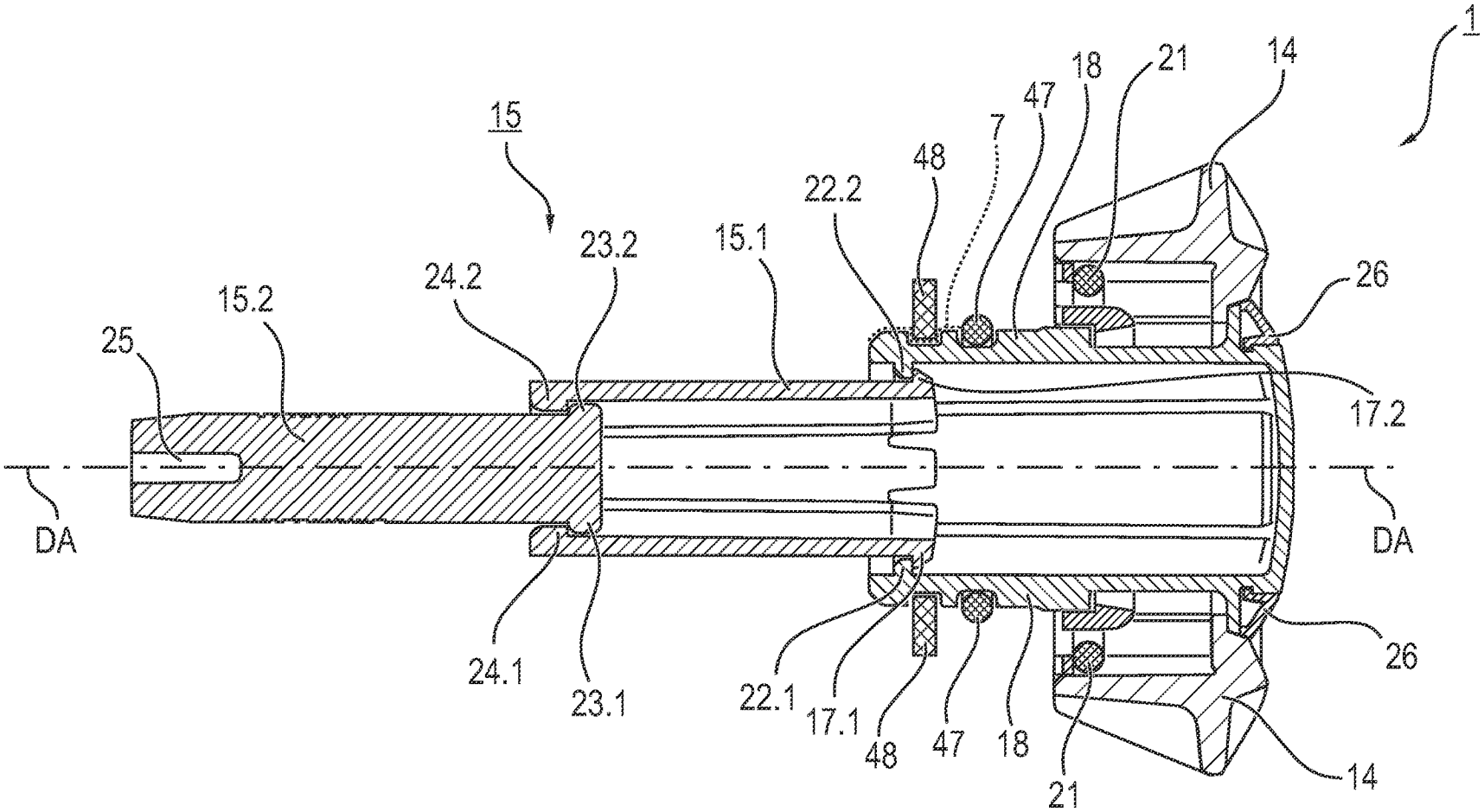
FIG. 8 is a cross-sectional view showing an embodiment of the telescopic actuating unit.

FIG. 8 shows a cross-sectional view through the actuating unit 1 and the telescopic bar 15. The following stop elements, which set the maximum length of the telescopic unit 18, 15.1, 15.2 and hence the maximum possible distance between the rear bearing ring parts 9.*l*, 9.*r* and the handwheel 14, are shown:

- stop elements 22.1, 22.2, . . . on the inside at the handwheel tube 18,
- stop elements 17.1, 17.2, . . . on the outside at the tube 15.1,
- stop elements 24.1, 24.2, . . . on the inside at the tube 15.1,
- stop elements 23.1, 23.2, . . . on the outside at the pin 15.2.

The minimum distance is limited by the length of the handwheel tube 18, by the length of the tube 15.1 and by the length of the pin 15.2, depending on which length is the greatest.

In addition, the following components are shown in FIG. 8:

- a profile of the helmet shell 7, with which the handwheel tube 18 is in contact, drawn in broken lines,
- the fluted disk 19,
- an O-ring 21,
- the screw hole 25, and
- the identification plate 26.

Thanks to the embodiment according to the present invention of the safety helmet 100, the range of the possible head sizes, which the bearing ring 5, 8, 9.*l*, 9.*r* can provide for a user of the safety helmet 100, is broader than in other possible transmission units between an actuating element and a bearing ring. It is possible, but not necessary thanks to the present invention, to replace a part of the safety helmet 100 in order to adapt the safety helmet 100 to a head size. As a result, the present invention reduces the number of necessary variants of components of the safety helmet 100, which must be kept ready. Furthermore, the present invention reduces the number of replacement parts for the safety helmet 100.

A distance inevitably develops between the rear bearing ring parts 8, 9.*l*, 9.*r* and the helmet shell 7. Hair of a user may enter into the intermediate space formed thereby. Thanks to the present invention, the risk of such hair being caught and clamped during an adjustment of the head size is lower than in case of other possible embodiments of a transmission unit.

The present invention eliminates the need to adjust the head size with the use of an elastic element. Such an elastic element can cause hair to be clamped. The elastic element may also wear out more rapidly than other parts.

Figure 13:
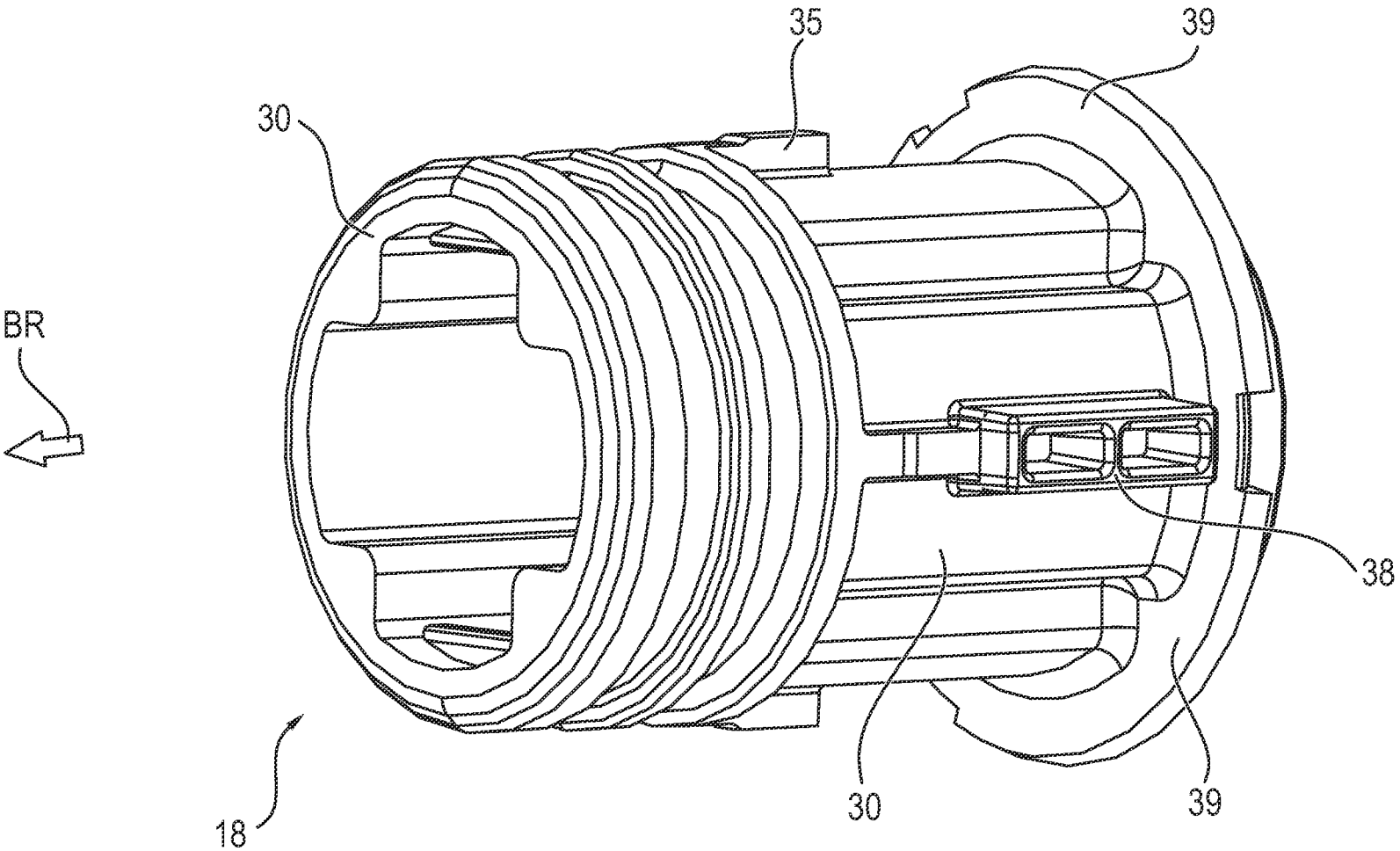
FIG. 13 is a perspective view showing the handwheel tube from an oblique viewing direction from the front.
Figure 14:
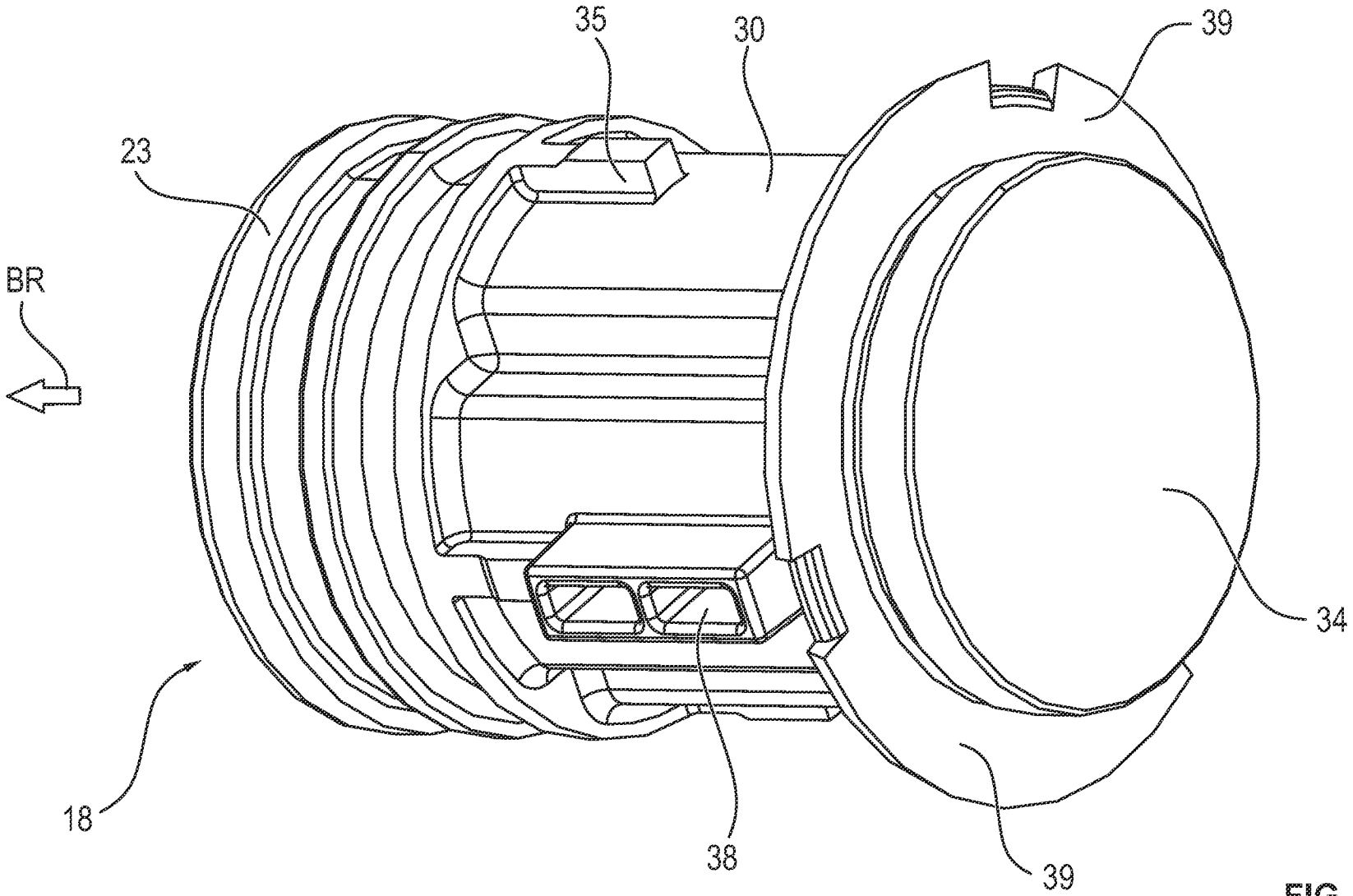
FIG. 14 is a perspective view showing the handwheel tube from an oblique viewing direction from the rear.
Figure 15:
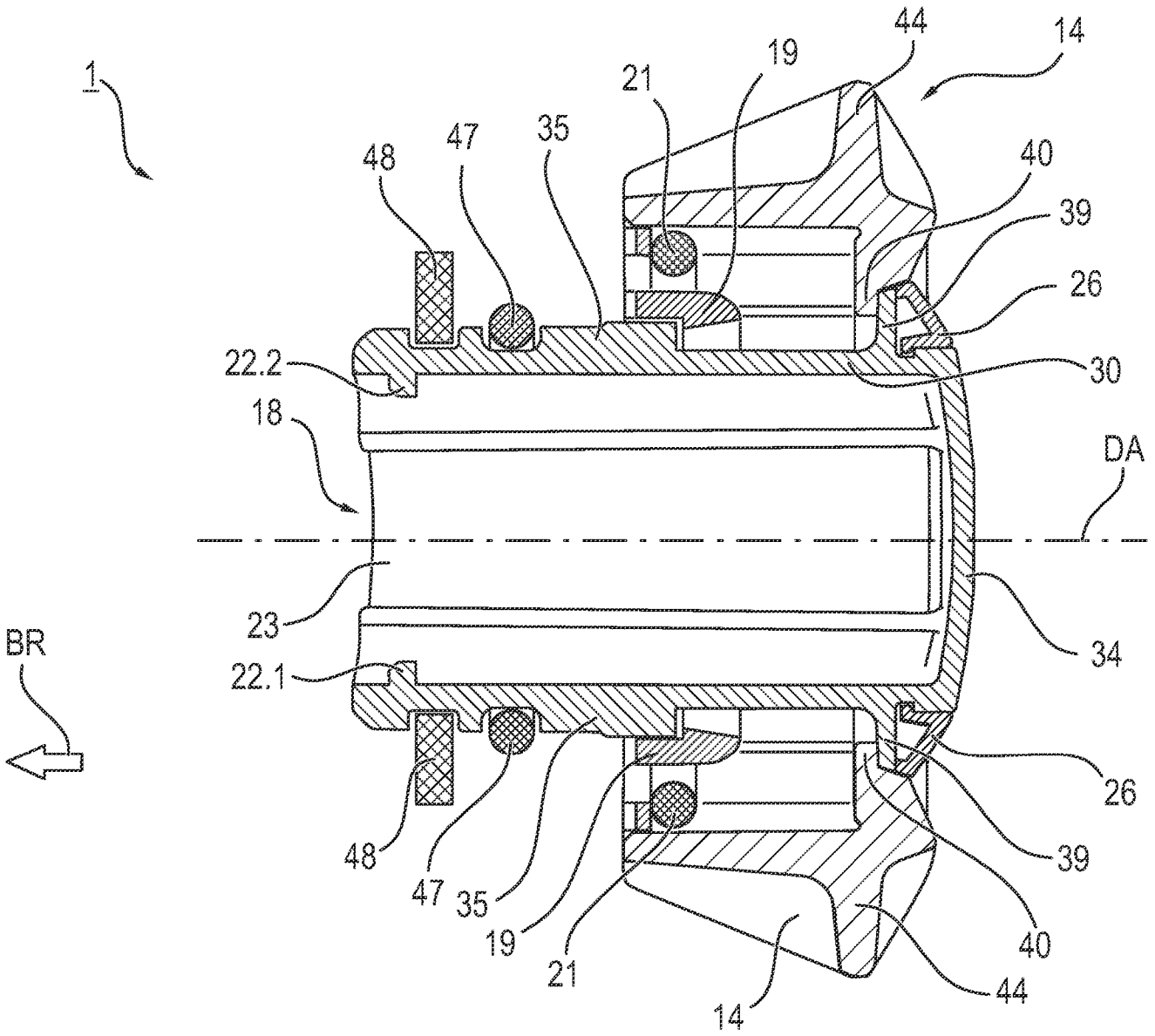
FIG. 15 is a cross-sectional view showing the actuating unit from the side.

FIG. 9, FIG. 10, FIG. 11 and FIG. 15 show the actuating unit 1 from four different viewing directions, namely, obliquely from the front (FIG. 9, where the handwheel 14 is behind the handwheel tube 18), from the side (FIG. 10) and straight from behind (FIG. 11, where the handwheel 14 is in front of the handwheel tube 18) in different perspective views. FIG. 15 shows in a cross-sectional view the actuating unit 1 from the side. FIG. 12 shows the handwheel 14 from an oblique viewing direction from the rear in a perspective view. FIG. 13 shows the handwheel tube 18 in a perspective view from an oblique viewing direction from the front, and FIG. 14 shows it obliquely from the rear.

The handwheel 14, the handwheel tube 18, the tube 15.1 and the pin 15.2 are arranged coaxially, i.e., they have the same central axis, and this central axis is identical to the rotation axis DA, and they are rotatable relative to the helmet shell 7 about this common central axis DA. The tube 15.1 can move relative to the pin 15.2 in two opposite directions in parallel to this common central axis DA. The handwheel tube 18 is omitted in FIG. 7.

The handwheel 14 is attached rotatably to the helmet shell 7, and it is attached indirectly by means of the handwheel tube 18, which is attached rotatably to the helmet shell 7, cf. FIG. 1 and FIG. 2. The handwheel tube 18 is non-rotatably connected to the tube 15.1 such that they rotate in unison, the connection being brought about by means of an inner profile of the handwheel tube 18 and of a corresponding outer profile of the tube 15.1, cf. FIG. 7, FIG. 8 and FIG. 9.

The handwheel tube 18 comprises a plurality of circular projections, which extend in parallel to the longitudinal axis, and a plurality of circular projections, which enclose the longitudinal axis. The handwheel tube 18 is attached rotatably to the helmet shell 7, cf. FIG. 13 and FIG. 14. A circular bead 20 is in contact with the helmet shell 7 and it encloses the handwheel tube 18, cf. FIG. 2 and FIG. 15. In one embodiment, this bead 20 holds, together with the circlip 48, the handwheel tube 18 at the helmet shell 7. In another embodiment, the handwheel tube 18 is held at the helmet shell 7 exclusively by the circlip 48.

The identification plate 26 is located in a groove of the handwheel 14 and it likewise encloses the handwheel tube 18, cf. FIG. 2 and FIG. 15. The identification plate 26 may have a color code. The handwheel 14 and the handwheel tube 18 as well as the arched disk 34 may also have a color code each, so that a combination of up to four color codes is possible.

Figure 9:
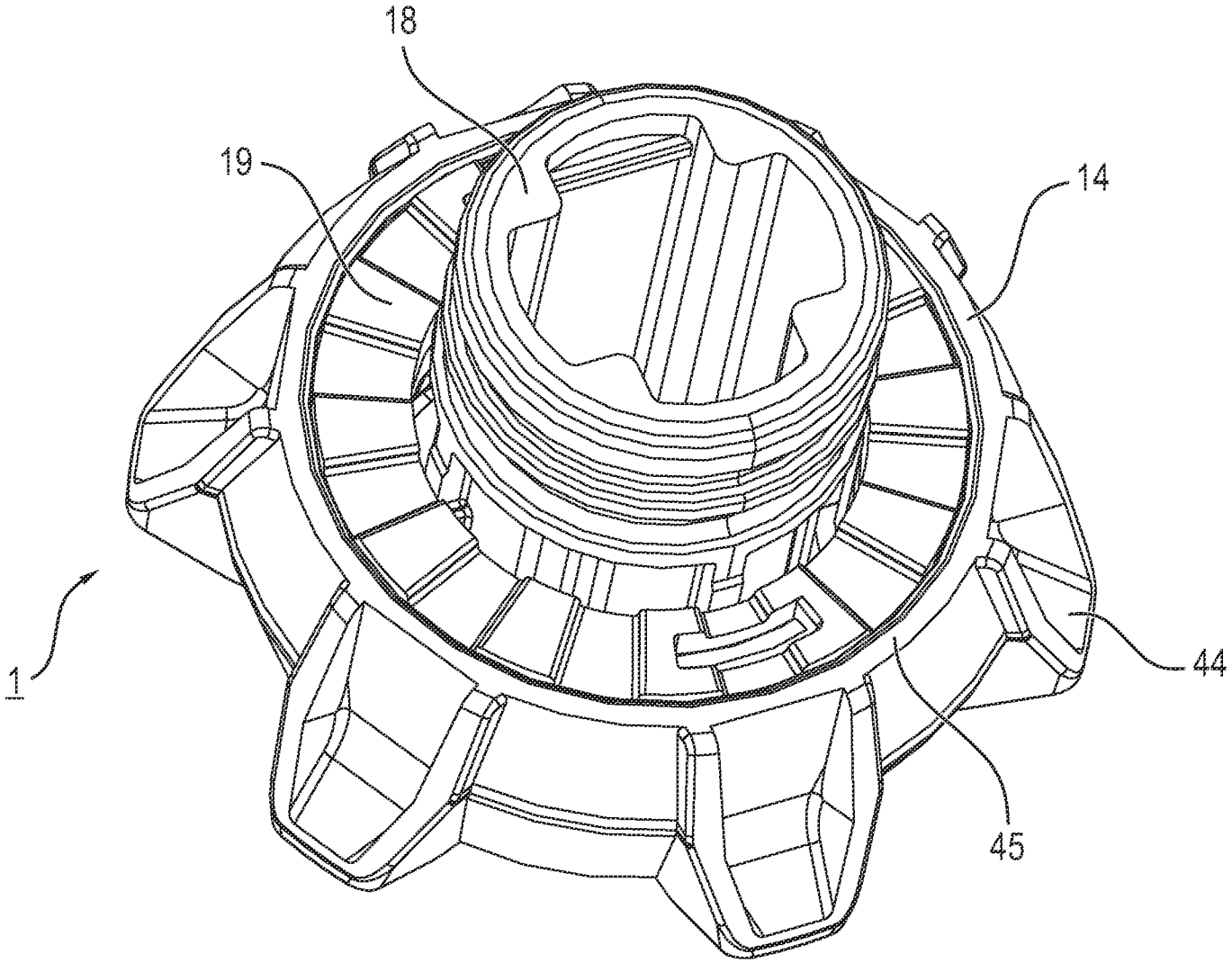
FIG. 9 is a perspective view showing the actuating unit obliquely from the inside.
Figure 10:
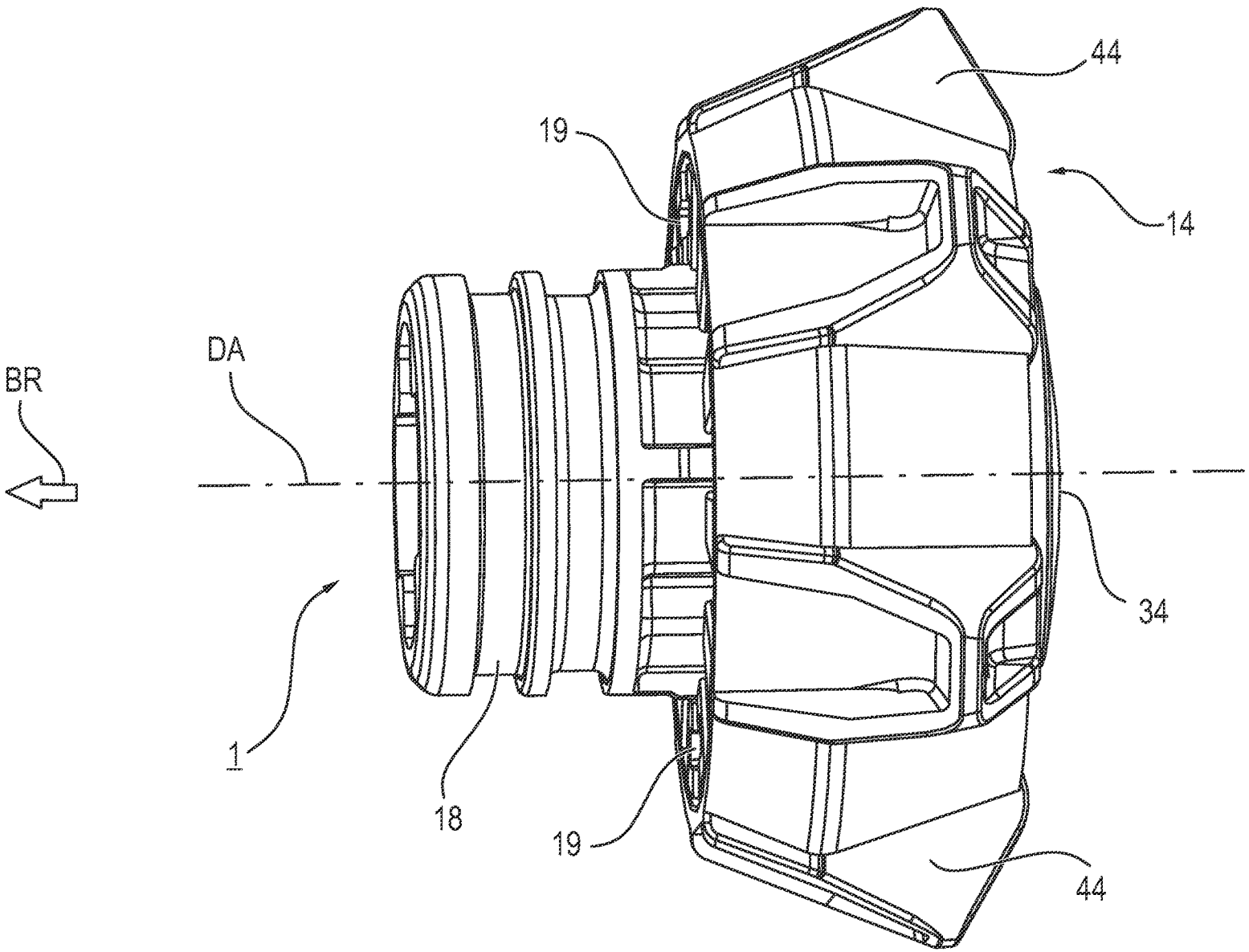
FIG. 10 is a side perspective view showing the actuating unit.

The handwheel tube 18 can rotate relative to the helmet shell 7 about its own central axis DA, but it cannot be displaced linearly in parallel to its own central axis DA or in another direction, and it cannot, in particular, be displaced by a translatory movement. The viewing direction in FIG. 9 is an oblique direction to the outside from the helmet shell 7, i.e., the handwheel 14 is located behind the helmet shell 7 not shown in FIG. 9.

Projections at the inner profile of the handwheel 14 mesh with corresponding recesses at the outer profile of the handwheel tube 18. As a result, the handwheel tube 18 is non-rotatably connected to the handwheel 14 such that they rotate in unison, i.e., a rotation of the handwheel 14 is transmitted to the handwheel tube 18 without an appreciable slip and it brings about a rotation of the handwheel tube 18.

A rotation of the handwheel 14 is transmitted, in addition, to the fluted disk 19. Flutes of the disk 19 are moved during a rotation of the handwheel 14 over projections 27 at the bead 20 and they bring about an audible rattling or clicking ("acoustic feedback"). The O-ring 21 is inserted into a groove of the handwheel tube 18, specifically between the handwheel 14 and the fluted disk 19, cf. FIG. 15. The O-ring 21 can be compressed in a direction parallel to the common central axis DA and it expands again by itself, it brings about a rebound and makes it possible for the fluted disk 19 to be able to move relative to the handwheel tube 18 and in parallel to the central axis DA of the handwheel tube 18, so that the flutes of the disk 19 can slide over the projections 27.

The tube (helmet shell-side transmission piece) 15.1 is guided on the inside by the handwheel tube 18. An outer profile of the tube 15.1 engages with an inner profile of the handwheel tube 18, and the outer profile and the inner profile have each the shape of a Swiss cross in this embodiment and they provide a cross fit. Thanks to these two profiles, which mesh with one another and therefore correspond to one another, the tube 15.1 is non-rotatably connected to the handwheel tube 18 in a positive-locking manner and such that they rotate in unison. A rotation of the handwheel 14 is transmitted therefore to the handwheel tube 18 and from the latter to the tube 15.1 without any appreciable slip and it brings about a rotation of the tube 15.1. The handwheel tube 18 is omitted in FIG. 7.

The tube 15.1 can be displaced relative to the handwheel tube 18 and hence relative to the handwheel 14 linearly in a direction parallel to the common central axis DA in both directions. A plurality of stop elements 17.1, 17.2 at one end of the tube 15.1 limit a possible movement of the tube 15.1 towards the transmitting gear 10, 11, 12, cf. FIG. 8. It is made possible in one embodiment for the tube 15.1 to project over the handwheel 14 on the outside. In another embodiment, the handwheel 14 covers the tube 15.1.

The pin (bearing ring-side transmission piece) 15.2 is located in the interior of the tube 15.1. An outer profile of the pin 15.2 engages with an inner profile of the tube 15.1. As a result, the pin 15.2 is non-rotatably connected to the tube 15.1 in a positive-locking manner and such that they rotate in unison. A rotation of the tube 15.1 brings about a rotation of the pin 15.2 without an appreciable slip. Projections on the outer profile of the pin 15.2 and corresponding projections on the inner profile of the tube 15.1 prevent the pin 15.2 from sliding out of the tube 15.1.

The screw 16 is passed through a recess in the driving toothed gear 10 and it holds the toothed gear 10 and the disk 33 at the inner end of the pin 15.2 and at the inner end of the driving toothed gear 10. The driving toothed gear 10 is prevented hereby from sliding off from the pin 15.2.

The driving toothed gear 10 is connected to the two rear bearing ring parts 9.*l* and 9.*r* via the driving toothed gears 11 and 12. In one embodiment, the driving toothed gear 10 can move linearly in both directions parallel to its central axis DA relative to the pin 15.2, and the toothed gear 10 is permanently connected in another embodiment to the pin 15.2 by means of the screw 16. The pin 15.2 can move linearly relative to the tube 15.1 in parallel to the central axis DA. The tube 15.1 can move relative to the handwheel tube 18 in parallel to the central axis DA. The handwheel tube 18 and hence the handwheel 14 are attached to the helmet shell 7. The distance between the helmet shell 7 and the two rear bearing ring parts 9.*l* and 9.*r* can consequently be changed by a multistep telescopic unit 18, 15.1, 15.2.

Figure 11:
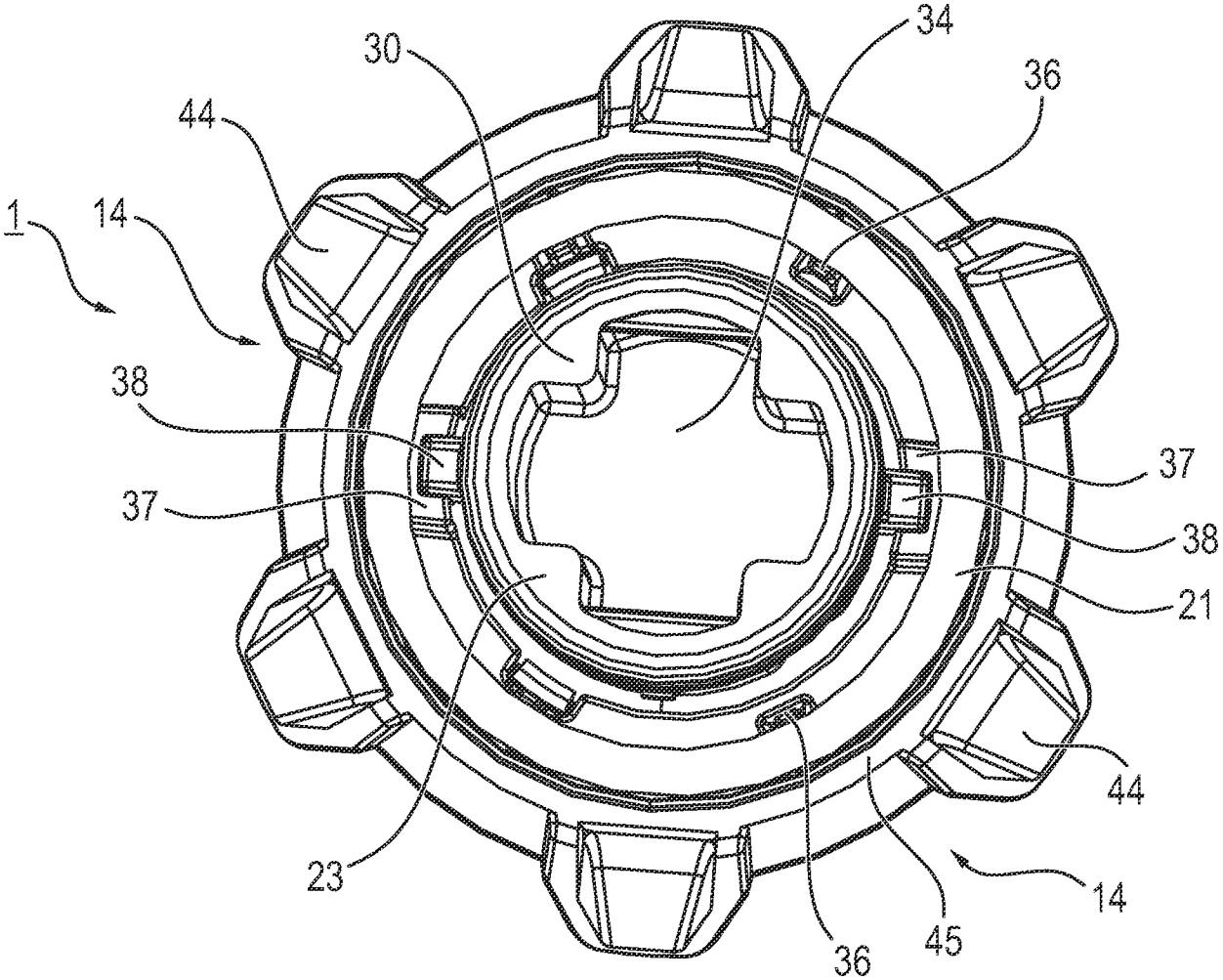
FIG. 11 is a rear perspective view showing the actuating unit, wherein the fluted disk is omitted.
Figure 12:
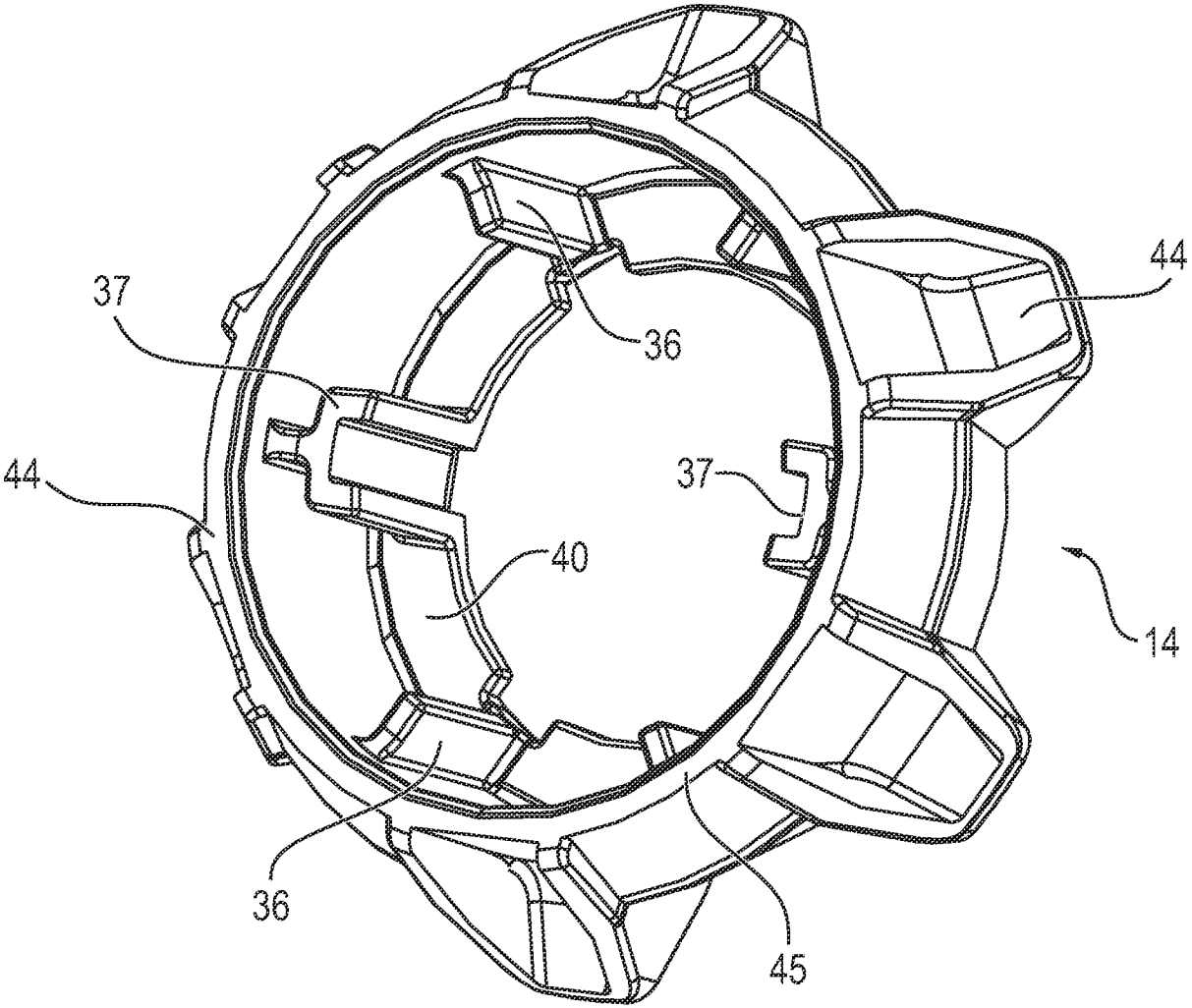
FIG. 12 is a perspective view showing the handwheel from an oblique viewing direction from the rear.

FIG. 11 and FIG. 12 show the following components of the handwheel 14:

- a round grip element 45, which comprises a plurality of outwardly pointing projections 44,
- two opposite projections 37 on the inside at the grip element 45 with the projections 44,
- four inwardly pointing projections 36, which act as reinforcing elements of the handwheel 14, and
- a stop element 40 in the form of a circular ring, cf. FIG. 15.

FIG. 11, FIG. 13 and FIG. 14 show the following components of the handwheel tube 18:

- a tube element 30, which has an inner profile, which corresponds to the outer profile of the tube 15,
- two opposite projections 38 on the outer profile of the tube element 30,
- four outwardly pointing projections 35, which act as reinforcing elements of the handwheel tube 18,
- a stop element 39 in the form of a circular disk on the outside at the rear end of the tube element 30, cf. FIG. 15, and
- the outwardly arched disk 34, which closes the tube element 30 to the outside.

The two projections 38 on the outside on the handwheel tube 18 mesh with two corresponding recesses on the projections 37 of the handwheel 14, cf. FIG. 11 through FIG. 14. A rotation of the handwheel 14 is transmitted by the elements 37 and 38 to the handwheel tube 18. The handwheel 14 is consequently non-rotatably connected to the handwheel tube 18 such that they rotate in unison.

The handwheel tube 18 is connected rotatably to the helmet shell 7. The handwheel tube 18 can be rotated about its own rotation axis DA relative to the helmet shell 7, but it cannot carry out any other movement and it cannot especially carry out any linear movement in parallel to its own rotation axis DA. The circlip 48 also contributes to this, among other things.

The handwheel 14 is preferably not connected directly to the helmet shell 7. The handwheel 14 is rather held by the handwheel tube 18. The handwheel 14 can move relative to the handwheel tube 18 in both directions in parallel to the common central axis DA. The two stop elements 39 and 40 limit a linear movement of the handwheel 14 away from the helmet shell 7. The stop element 40 of the handwheel 14 especially abuts against the stop element 39 of the handwheel tube 18 from the inside, cf. FIG. 15. The circular bead 20 limits a linear movement of the handwheel 14 towards the helmet shell 7, cf. FIG. 2.

The identification plate 26 is clamped into a corresponding bead, which is located between the disk 34 and the tube element 30 of the handwheel tube 18, cf. FIG. 15.

While specific embodiments of the invention have been shown and described in detail to illustrate the application of the principles of the invention, it will be understood that the invention may be embodied otherwise without departing from such principles.

LIST OF REFERENCE CHARACTERS

- 1 Actuating unit for adjusting the head size; it comprises the handwheel 14, the handwheel tube 18, the fluted disk 19, the disks 34 and 26 and the O-ring 21
- 2 Centrally arranged front holding ring part, attached to the helmet shell 7; it is in contact with the shock-absorbing shell 6
- 3 Guide element for the rear bearing ring parts 9.*l*, 9.*r*; attached to the helmet shell 7
- 4 Pivotable visor
- 5 Front bearing ring part, connected to the rear bearing ring parts 9.*l*, 9.*r* in an articulated manner
- 6 Shock-absorbing shell; it is located on the inside in the helmet shell 7; it absorbs kinetic energy
- 7 Arched helmet shell; it carries the holding ring 2 and the handwheel 14
- 8 Central rear bearing ring part in the form of a bearing support for the back of the head, arranged between the bearing ring parts 9.*l* and 9.*r*
- 9.*l* Left rear bearing ring part, connected to the front bearing ring part 5 in an articulated manner

9.*r* Right rear bearing ring, connected to the front bearing ring part 5 in an articulated manner

10 Driving toothed gear, connected to the handwheel 14 via a telescopic bar 15

11 Driven smaller toothed gear, meshing with the driving toothed gear 10

12 Driven larger toothed gear, connected permanently to the driven smaller toothed gear 11, meshing with the two toothed segments 13.*l* and 13.*r*

13 Toothed segment of the left rear bearing ring 9.*l*, in meshing engagement with the driven larger toothed gear 12

13.*r* Toothed segment of the right rear bearing ring 9.*r*, in meshing engagement with the driven larger toothed gear 12

14 Handwheel of the actuating unit 1; it accommodates in the interior the handwheel tube

18, comprises the grip element 45 with the projections 44 and the stop element 40

15 Telescopic bar, which connects the handwheel 14 to the driving toothed gear 10

15.1 Tube of the bar 15, guided on the inside by the handwheel tube 18, may project over the handwheel 14; is non-rotatably (torsion proof) connected to the pin 15.2 in a positive-locking manner such that they rotate in unison; acts as the helmet shell-side transmission piece

15.2 Pin of the bar 15; guided on the inside by the tube 15.1; non-rotatably (torsion proof) connected to the tube 15.1 in a positive-locking manner such that they rotate in unison; acts as the bearing ring-side transmission piece

16 Screw, which prevents the driving toothed gear 10 from sliding off from the pin 15.2; passed through the disk 33

17.1,

17.2, . . . Stop elements on the outside at the outer end of the tube 15.1; they limit a linear movement of the tube 15.1 towards the driving toothed gear 10

18 Handwheel tube, guided on the inside by the handwheel 14, by the fluted disk 19 and by the helmet shell 7; non-rotatably (torsion proof) connected to the tube 15.1 in a positive-locking manner such that they rotate in unison; held by the circlip 48

19 Fluted disk, non-rotatably (torsion proof) connected to the handwheel 14 such that they rotate in unison

20 Circular bead on the helmet shell 7; it encloses the handwheel tube 18, has projections 27 for the "acoustic feedback" when the handwheel 14 is being rotated

21 O-ring between the fluted disk 19 and the handwheel 14

22.1,

22.2, . . . Stop elements on the inside at the handwheel tube 18; they correspond to the stop elements 17.1, 17.2, . . .

23.1,

23.2, . . . Stop elements on the outside at the pin 15.2; they correspond to the stop elements

24.1, 24.2

24.1,

24.2, . . . Stop elements on the inside at the tube 15.1; they correspond to the stop elements

23.1, 23.2

25 Screw hole at the inner end of the pin 15.2

26 Identification plate; it encloses the handwheel tube 18; it is enclosed by the handwheel 14

27 Projections at the bead 20; they correspond to flutes on the fluted disk 19

28 Rigid intermediate piece between the front holding ring 2 and the front bearing ring part 5

29 Centrally arranged rear holding ring part, attached on the inside to the helmet shell 7

30 Tube element of the handwheel tube 18; it provides an inner profile

31.*l* Snap-in connection between the front bearing ring part 5 and the left rear bearing ring part 9.*l*

31.*r* Snap-in connection between the front bearing ring part 5 and the right rear bearing ring part 9.*r*

32 Additional visor, attached pivotably to the front holding ring part 2

33 Disk at the front end of the pin 15.2; permanently connected to the driving toothed gear by means of the screw 16

34 Arched disk, which closes the handwheel tube 18; it holds the identification plate 26 together with the tube element 30

35 Projections of a first kind on the outside at the handwheel tube 18; they act as reinforcing elements and adjoin the fluted disk 19

36 Projections of a first kind on the inside at the handwheel 14; they act as reinforcing elements

37 Projections of a second kind on the inside at the handwheel 14; they receive the projections 38 and bring about the non-rotatably (torsion proof) connection to the handwheel tube 18 such that they rotate in unison

38 Projections of a second kind on the outside at the handwheel tube 18; they mesh with the projections 37, and bring about the non-rotatably (torsion proof) connection to the handwheel 14 such that they rotate in unison

39 Stop element on the outside at the handwheel tube 18

40 Circular ring at the handwheel 14; it acts as a stop element, which abuts against the stop element 39

44 Outwardly pointing projections at the round grip element 45

45 Round grip element of the handwheel 14; it comprises the projections 44

47 Sealing ring, placed around the handwheel tube 18

48 Circlip, placed around the handwheel tube 18

100 Safety helmet, comprises the helmet shell 7, the shock-absorbing shell 6, the front holding ring part 2, the rear holding ring part 29, the bearing ring with the bearing ring parts 5, 8, 9.*l*, 9.*r* and the actuating unit 1

BR Viewing direction of a user of the safety helmet 100, who is looking straight forward

What is claimed is:

1. A safety helmet process comprising:

providing a safety helmet comprising: an arched helmet shell; a bearing ring attached on an inside to the helmet shell and configured to fully or at least partially encompass a head of a user of the safety helmet and to determine a head size of the safety helmet; an actuating element accessible from an outside and attached rotatably to the helmet shell; and a transmission unit configured to transmit a rotation of the actuating element to the bearing ring such that the head size provided by the bearing ring is changed, wherein the transmission unit comprises: a helmet shell-side transmission piece non-rotatably connected to the actuating element so as to rotate in unison with the actuating element; and a bearing ring-side transmission piece, wherein the helmet shell-side transmission piece and the bearing ring-side transmission piece together at least partially bridge a distance between the actuating element and the bearing ring and extend along a common longitudinal axis, wherein: the helmet shell-side transmission piece is configured to move, linearly in parallel to the common longitudinal axis, relative to the actuating element in two opposite directions; the bearing ring-side transmission piece is non-rotatably connected to the helmet shell-side transmission piece so as to be rotatable in unison therewith and is mechanically connected to the bearing ring; the bearing ring-side transmission piece is configured to move, linearly in parallel to the common longitudinal axis, relative to the helmet shell-side transmission piece in two opposite directions; and the distance between the actuating element and the bearing ring is changeable both by a linear movement of the helmet shell-side transmission piece relative to the actuating element and by a linear movement of the bearing ring-side transmission piece relative to the helmet shell-side transmission piece;

providing a 3D printer configured to produce at least one of the bearing ring, the actuating element and the transmission unit; and producing at least one of the bearing ring, the actuating element and the transmission unit with the 3D printer.

2. A safety helmet process according to claim 1, further comprising:

providing at least another 3D printer configured to produce at least one of the bearing ring, the actuating element and the transmission unit;

producing at least one of the bearing ring, the actuating element and the transmission unit with the other 3D printer.

3. A safety helmet process according to claim 2, wherein the 3D printer and the other 3D printer:

are at different locations; or produce different components of the safety helmet; or are at different locations and produce different components of the safety helmet.

4. A safety helmet process comprising:

providing a 3D printer;

producing at least one of a bearing ring, an actuating element and a transmission unit with the 3D printer;

forming a safety helmet comprising: an arched helmet shell; the bearing ring attached on an inside to the helmet shell and configured to fully or at least partially encompass a head of a user of the safety helmet and to determine a head size of the safety helmet; the actuating element accessible from an outside and attached rotatably to the helmet shell; and the transmission unit configured to transmit a rotation of the actuating element to the bearing ring such that the head size provided by the bearing ring is changed, wherein the transmission unit comprises: a helmet shell-side transmission piece non-rotatably connected to the actuating element so as to rotate in unison with the actuating element; and a bearing ring-side transmission piece, wherein the helmet shell-side transmission piece and the bearing ring-side transmission piece together at least partially bridge a distance between the actuating element and the bearing ring and extend along a common longitudinal axis, wherein: the helmet shell-side transmission piece is configured to move, linearly in parallel to the common longitudinal axis, relative to the actuating element in two opposite directions; the bearing ring-side transmission piece is non-rotatably connected to the helmet shell-side transmission piece so as to be rotatable in unison therewith and is mechanically connected to the bearing ring; the bearing ring-side transmission piece is configured to move, linearly in parallel to the common longitudinal axis, relative to the helmet shell-side transmission piece in two opposite directions; and the distance between the actuating element and the bearing ring is changeable both by a linear movement of the helmet shell-side transmission piece relative to the actuating element and by a linear movement of the bearing ring-side transmission piece relative to the helmet shell-side transmission piece.

5. A safety helmet process according to claim 4, further comprising:

providing at least another 3D printer configured to produce at least one of the bearing ring, the actuating element and the transmission unit;

producing at least one of the bearing ring, the actuating element and the transmission unit with the other 3D printer.

6. A safety helmet process according to claim 5, wherein the 3D printer and the other 3D printer:

are at different locations; or produce different components of the safety helmet; or are at different locations and produce different components of the safety helmet.

* * * * *